US008561245B2

(12) United States Patent
Weis

(10) Patent No.: US 8,561,245 B2
(45) Date of Patent: Oct. 22, 2013

(54) CLEANING IMPLEMENT

(75) Inventor: Norbert Weis, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 231 days.

(21) Appl. No.: 13/131,691

(22) PCT Filed: Dec. 1, 2009

(86) PCT No.: PCT/IB2009/007613
§ 371 (c)(1),
(2), (4) Date: May 27, 2011

(87) PCT Pub. No.: WO2010/064117
PCT Pub. Date: Jun. 10, 2010

(65) Prior Publication Data

US 2011/0225754 A1 Sep. 22, 2011

Related U.S. Application Data

(60) Provisional application No. 61/118,925, filed on Dec. 1, 2008.

(51) Int. Cl.
*A47L 13/146* (2006.01)

(52) U.S. Cl.
USPC ..... 15/119.2; 15/116.2

(58) Field of Classification Search
USPC ..... 15/116.2, 119.2
See application file for complete search history.

(56) References Cited

U.S. PATENT DOCUMENTS

| | | | |
|---|---|---|---|
| 1,655,585 | A | 1/1928 | Wagner |
| 2,442,467 | A | 6/1948 | Lux |
| 2,730,738 | A | 1/1956 | Humes |
| 2,774,091 | A | 12/1956 | Greenleaf |
| 2,858,557 | A | 11/1958 | Zottola |
| 3,050,761 | A | 8/1962 | Morgan |

(Continued)

FOREIGN PATENT DOCUMENTS

| | | | |
|---|---|---|---|
| DE | 1954499 | U | 2/1967 |
| DE | 29713657 | U1 | 11/1997 |

(Continued)

OTHER PUBLICATIONS

European Patent Office, International Search Report and Written Opinion in International Patent Application No. PCT/IB2009/007613 (Mar. 9, 2010).

(Continued)

*Primary Examiner* — Randall Chin
(74) *Attorney, Agent, or Firm* — Leydig, Voit & Mayer, Ltd.

(57) ABSTRACT

A cleaning implement (10) comprising a handle (12) a cleaning end (24) coupled to the handle, and a cleaning head (14). The cleaning head may be removably coupled to the cleaning end, and can include a pair of tabs (30) extending through an aperture (32) in the cleaning end. Each tab may have a finger grip (56), and the finger grips may be generally offset from one another. Each tab may have a ledge (50) for contacting an upper surface of the cleaning end near a perimeter of the aperture to retain the cleaning head to the cleaning end. The tabs may be movable such that the ledges are moved out of contact with the upper surface of the cleaning end when removing the cleaning head from the cleaning end.

17 Claims, 7 Drawing Sheets

(56) References Cited

U.S. PATENT DOCUMENTS

| | | | | |
|---|---|---|---|---|
| 3,188,676 | A | 6/1965 | Zelinski et al. | |
| 4,216,562 | A * | 8/1980 | Strahs | 15/119.2 |
| 4,324,016 | A | 4/1982 | Herbig | |
| 4,654,920 | A | 4/1987 | O'Neil, Jr. et al. | |
| D294,415 | S | 2/1988 | Jones | |
| 4,748,710 | A | 6/1988 | Jones | |
| 4,864,675 | A | 9/1989 | Jones | |
| D323,727 | S | 2/1992 | Re | |
| D328,807 | S | 8/1992 | Millar | |
| 5,271,682 | A | 12/1993 | Realdon | |
| 5,272,783 | A | 12/1993 | Richardson et al. | |
| D358,244 | S | 5/1995 | Teufel et al. | |
| 5,488,750 | A | 2/1996 | Vosbikian et al. | |
| 5,528,791 | A | 6/1996 | Wilson | |
| D386,851 | S | 11/1997 | Levine | |
| D389,625 | S | 1/1998 | Feldman et al. | |
| 5,881,423 | A | 3/1999 | Shumway et al. | |
| 5,896,613 | A | 4/1999 | Courtney et al. | |
| 5,920,942 | A | 7/1999 | Footer | |
| 5,979,004 | A | 11/1999 | Wilson | |
| 6,003,187 | A | 12/1999 | Footer et al. | |
| RE36,635 | E | 4/2000 | Vosbikian et al. | |
| 6,058,548 | A | 5/2000 | Footer et al. | |
| 6,178,581 | B1 | 1/2001 | Lewis | |
| D446,896 | S | 8/2001 | Cann | |
| 6,336,240 | B1 * | 1/2002 | Laux et al. | 15/104.94 |
| 6,389,635 | B1 | 5/2002 | Petner et al. | |
| D477,301 | S | 7/2003 | Hollinger | |
| 6,612,768 | B2 | 9/2003 | Zorzo | |
| 6,644,877 | B1 | 11/2003 | Chen | |
| 6,647,983 | B2 | 11/2003 | Smith et al. | |
| 6,675,426 | B2 | 1/2004 | Ohm et al. | |
| 6,698,056 | B1 | 3/2004 | Oretti et al. | |
| D496,766 | S | 9/2004 | Colburn et al. | |
| 6,785,928 | B2 | 9/2004 | Specht et al. | |
| 6,854,149 | B1 | 2/2005 | Specht et al. | |
| 6,953,299 | B2 | 10/2005 | Wang et al. | |
| 6,976,282 | B2 | 12/2005 | Sie | |
| D531,367 | S | 10/2006 | Hay | |
| 7,257,853 | B2 | 8/2007 | Boyer et al. | |
| D572,871 | S | 7/2008 | Erken | |
| D582,619 | S | 12/2008 | Kong | |
| 2002/0073498 | A1 | 6/2002 | Hirse | |
| 2002/0124339 | A1 | 9/2002 | Cann | |
| 2002/0162573 | A1 | 11/2002 | Fernandez | |
| 2003/0205243 | A1 | 11/2003 | Fernandez | |
| 2004/0071490 | A1 | 4/2004 | Vosbikian et al. | |
| 2004/0187239 | A1 | 9/2004 | Libman et al. | |
| 2004/0265037 | A1 | 12/2004 | Vosbikian et al. | |
| 2005/0011536 | A1 | 1/2005 | Hofte et al. | |
| 2005/0028309 | A1 | 2/2005 | Boyer et al. | |
| 2005/0155171 | A1 | 7/2005 | Boyer et al. | |
| 2007/0089255 | A1 | 4/2007 | Michelson et al. | |
| 2007/0136963 | A1 | 6/2007 | Vosbikian et al. | |

FOREIGN PATENT DOCUMENTS

| | | | |
|---|---|---|---|
| DE | 20310699 | U1 | 10/2003 |
| EP | 1208788 | A1 | 5/2002 |
| FR | 2708846 | A1 | 2/1995 |
| FR | 2709056 | A3 | 2/1995 |
| GB | 2258142 | A | 2/1993 |
| NL | 6 401 510 | A | 8/1964 |
| WO | WO 96/08991 | A1 | 3/1996 |
| WO | WO 99/05957 | A1 | 2/1999 |
| WO | WO 99/59459 | A1 | 11/1999 |
| WO | WO 2004/054424 | A1 | 7/2004 |
| WO | WO 2004/062821 | A1 | 7/2004 |
| WO | WO 2004/080265 | A2 | 9/2004 |
| WO | WO 2005/074780 | A1 | 8/2005 |
| WO | WO 2007/076305 | A2 | 7/2007 |

OTHER PUBLICATIONS

Freudenberg Household Products LP, image of Big Easy® mop, available before Mar. 14, 2008, 1 page.

* cited by examiner

CLEANING IMPLEMENT

CROSS-REFERENCE TO RELATED APPLICATIONS

This patent application is the U.S. national phase of International Patent Application No. PCT/IB2009/007613, filed Dec. 1, 2009, which claims the benefit of U.S. Provisional Patent Application No. 61/118,925, filed Dec. 1, 2008, each of which is incorporated by reference in its entirety herein.

BACKGROUND

A wide variety of cleaning implements are known in the art, and the prior art has provided numerous sweepers, brooms, mops, and the like. One well-known type of cleaning implement is a sponge mop. Sponge mops typically have a mop head supported on the end of a handle. Sponge mops also typically have some type of wringing mechanism to squeeze liquid from the mop head.

One type of sponge mop is a butterfly mop. A butterfly mop has a mop head that is foldable along a central axis. A butterfly mop generally includes a wringing mechanism that can be used to fold the mop head along the central axis.

On occasion, the mop head on a sponge mop has to be changed. For example, over time the mop head may become worn or soiled from use. Unfortunately, however, with many sponge mops, changing the mop head can be a cumbersome and time consuming task.

BRIEF SUMMARY

A cleaning implement is disclosed comprising a handle, a cleaning end coupled to the handle, and a cleaning head. The cleaning head may be removably coupled to the cleaning end, and can include a pair of tabs extending through an aperture in the cleaning end. Each tab may have a finger grip, and the finger grips may be generally offset from one another. Each tab can have a ledge for contacting an upper surface of the cleaning end near a perimeter of the aperture to retain the cleaning head to the cleaning end. The tabs may be movable such that the ledges are moved out of contact with the upper surface of the cleaning end when removing the cleaning head from the cleaning end.

In addition, a cleaning head is disclosed comprising a cleaning material, a backing coupled to the cleaning material, and a pair of tabs extending from the backing. Each tab may have a finger grip, and the finger grips can be generally offset from one another. Each tab can have a ledge.

Further, a cleaning implement is disclosed comprising a handle, a cleaning end coupled to the handle, and a cleaning head removably coupled to the cleaning end. The cleaning head can include a tab extending through the aperture, and the tab may have a finger grip. The finger grip may also have a ledge for contacting an upper surface of the cleaning end near a perimeter of the aperture to retain the cleaning head to the cleaning end. The tab can be movable such that the ledge is moved out of contact with the upper surface of the cleaning end when removing the cleaning head from the cleaning end.

DETAILED DESCRIPTION

Figure 1:
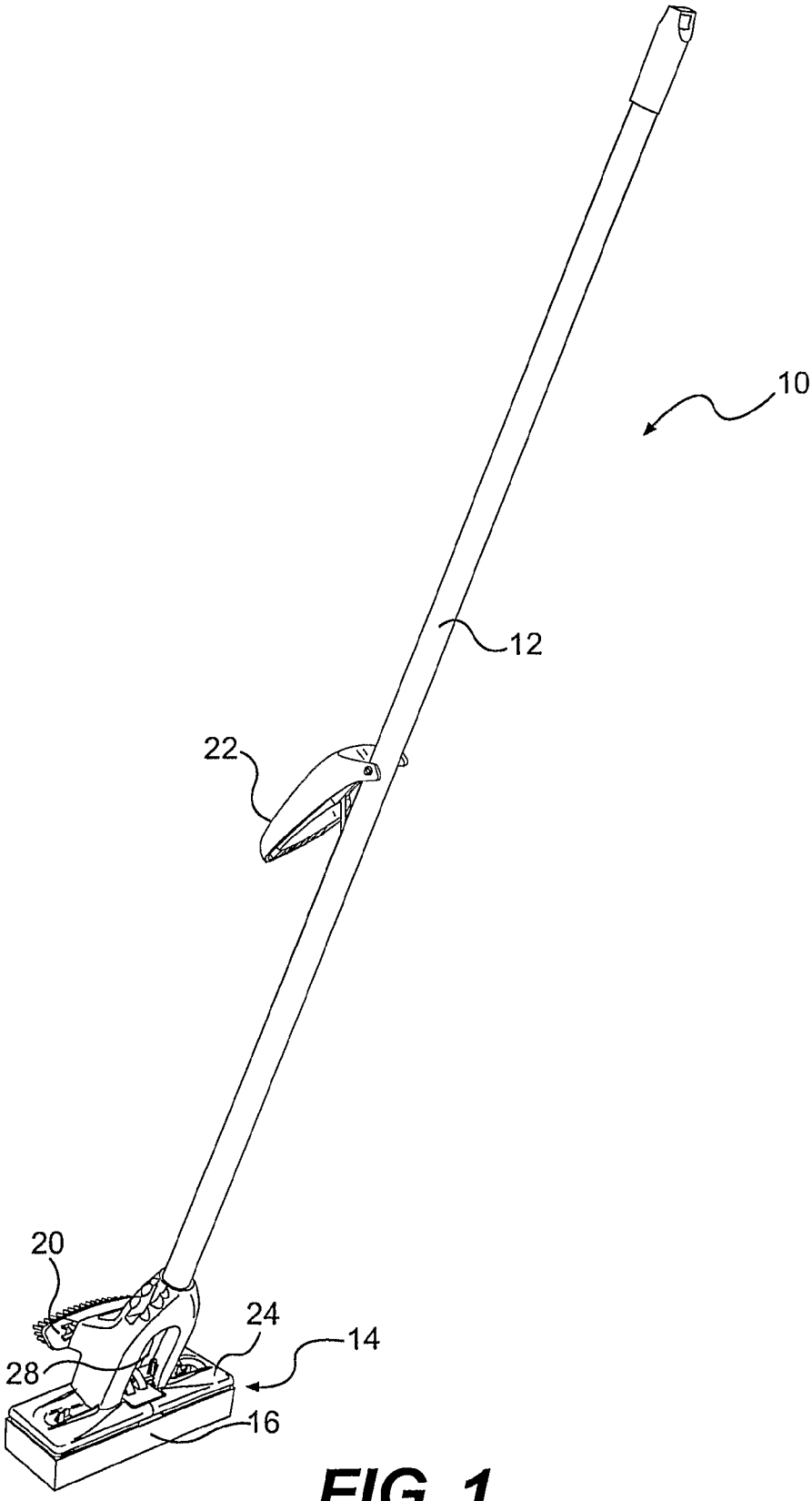
FIG. 1 is a perspective view of an exemplary cleaning implement according to the present invention.
Figure 2:
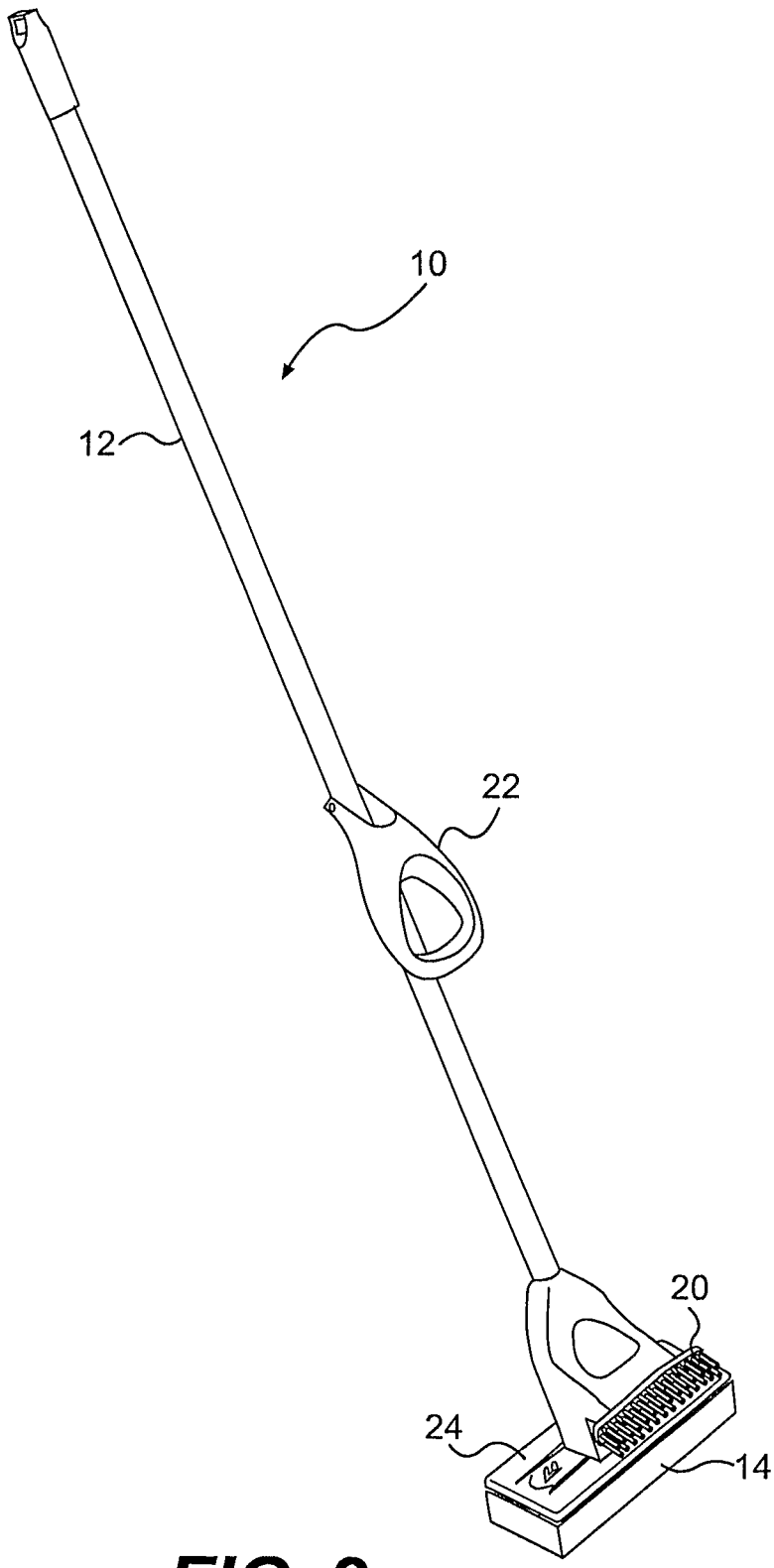
FIG. 2 is another perspective view of the cleaning implement of FIG. 1.
Figure 3:
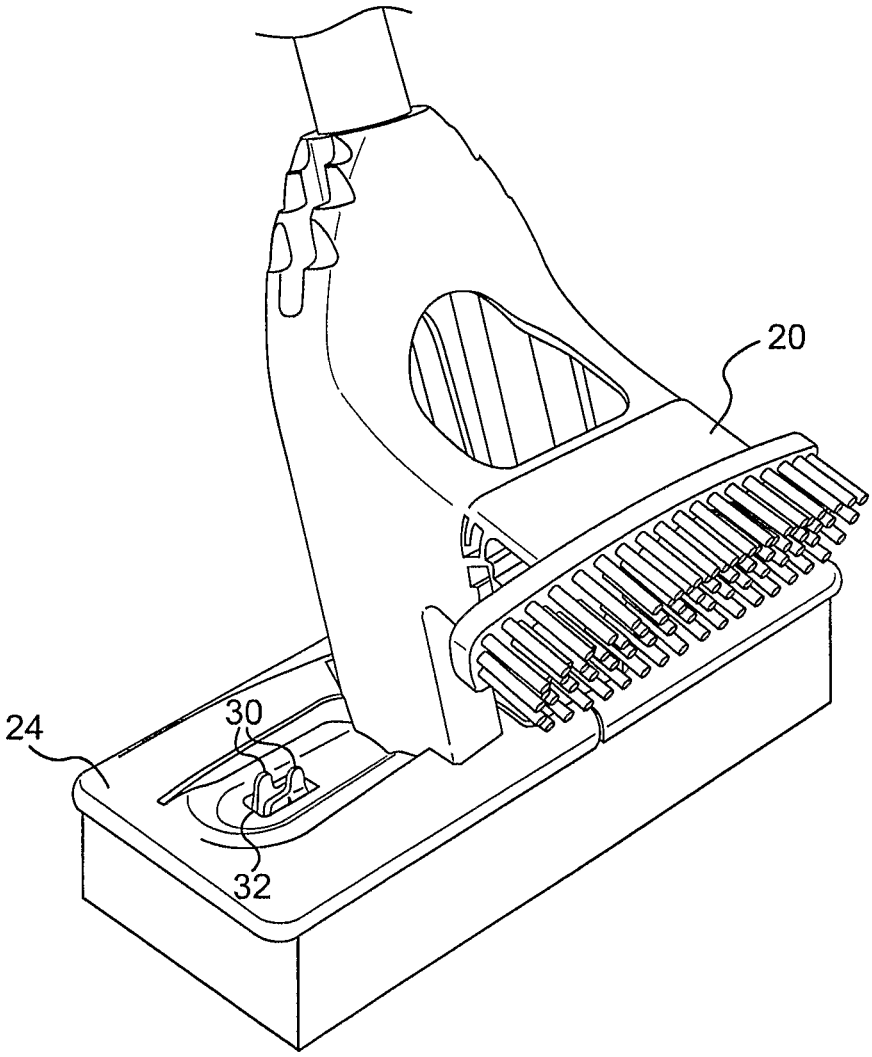
FIG. 3 is an enlarged perspective view of the cleaning end of the cleaning implement of FIG. 1.
Figure 5:
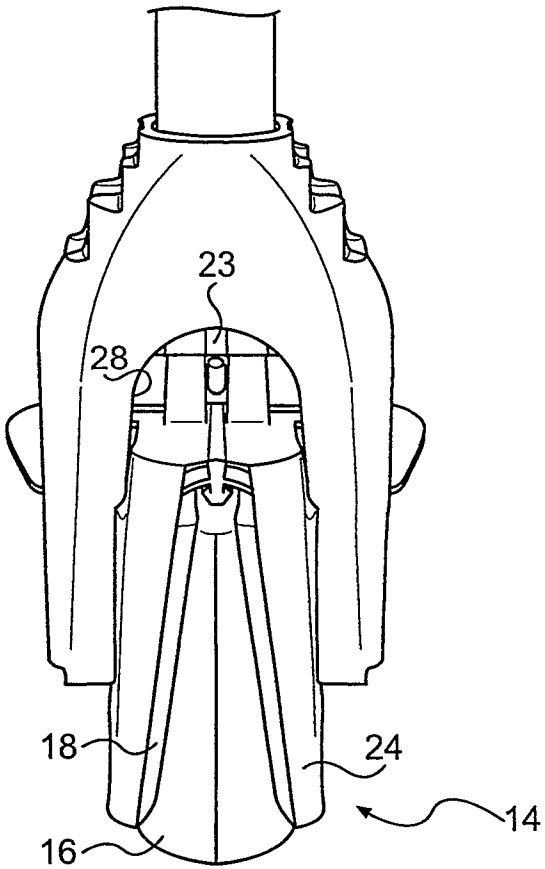
FIG. 5 is an enlarged rear elevational view of the cleaning end of the cleaning implement of FIG. 1 in the closed position.
Figure 4:
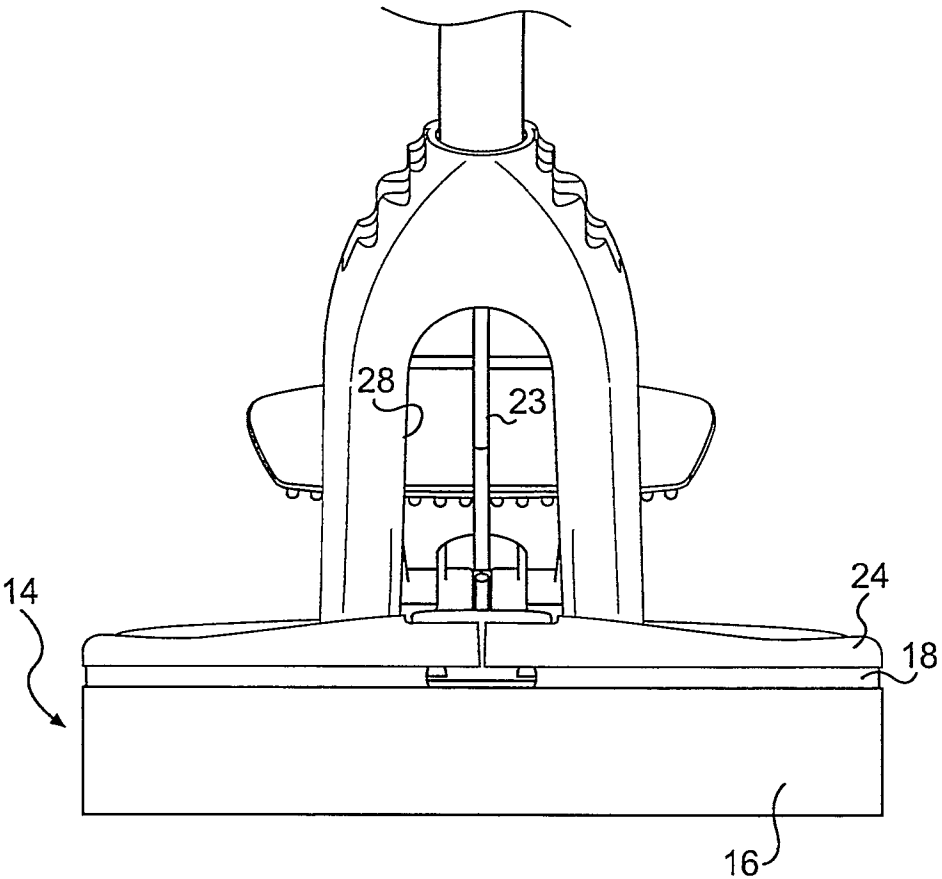
FIG. 4 is an enlarged rear elevational view of the cleaning end of the cleaning implement of FIG. 1 in the open position.
Figure 6:
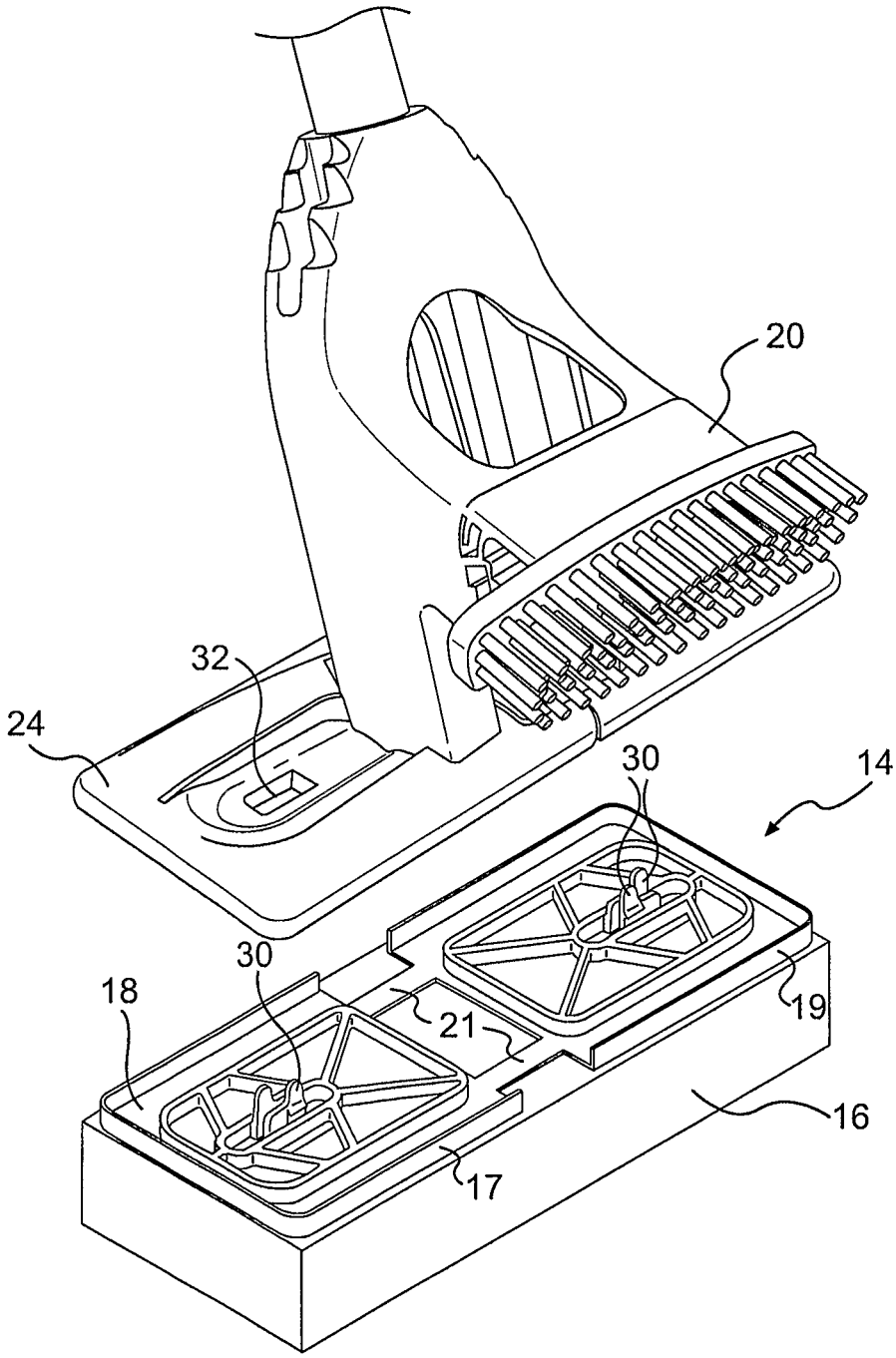
FIG. 6 is an enlarged perspective view of the end of the cleaning implement of FIG. 1 with the cleaning head detached.

Referring to FIGS. 1 and 2 of the drawings, there is shown an exemplary cleaning implement 10 according to the present invention. The cleaning implement 10 generally includes a handle 12 that has a cleaning head, such as the illustrated mop head 14, arranged at a cleaning end thereof, shown as wing assembly 24. As shown in FIGS. 3 and 6, the illustrated mop head 14 includes a cleaning material, such as a sponge element 16, that has a backing plate 18 connected on an upper side of the sponge element 16. The cleaning implement 10 may further include a scrubber attachment 20, which in the illustrated embodiment is a brush. The scrubber attachment 20 may be supported on the handle 12 near the mop head 14. In addition, the scrubber attachment 20 can be fixed or removable.

To allow fluid to be expelled from the mop head, the illustrated cleaning implement includes a wringing mechanism. Referring to FIGS. 1, 2, 4, and 5, the wringing mechanism includes, in this example, a pull bar 22 that is pivotally supported on the handle 12 and that controls movement of a link 23 that extends through the interior of the handle 12. At the lower end of the handle 12, the link 23 connects to a wing assembly 24 that moves the mop head 14 between an open mopping position in FIG. 4 and a closed wringing position in FIG. 5. To this end, the wing assembly 24 can include two lateral side portions that are hinged near a center axis portion that extends between the two lateral side, portions of the wing assembly. A spring can be arranged at the hinge that biases the wing assembly 24, and with it the mop head 14, into the open position.

Figure 7:
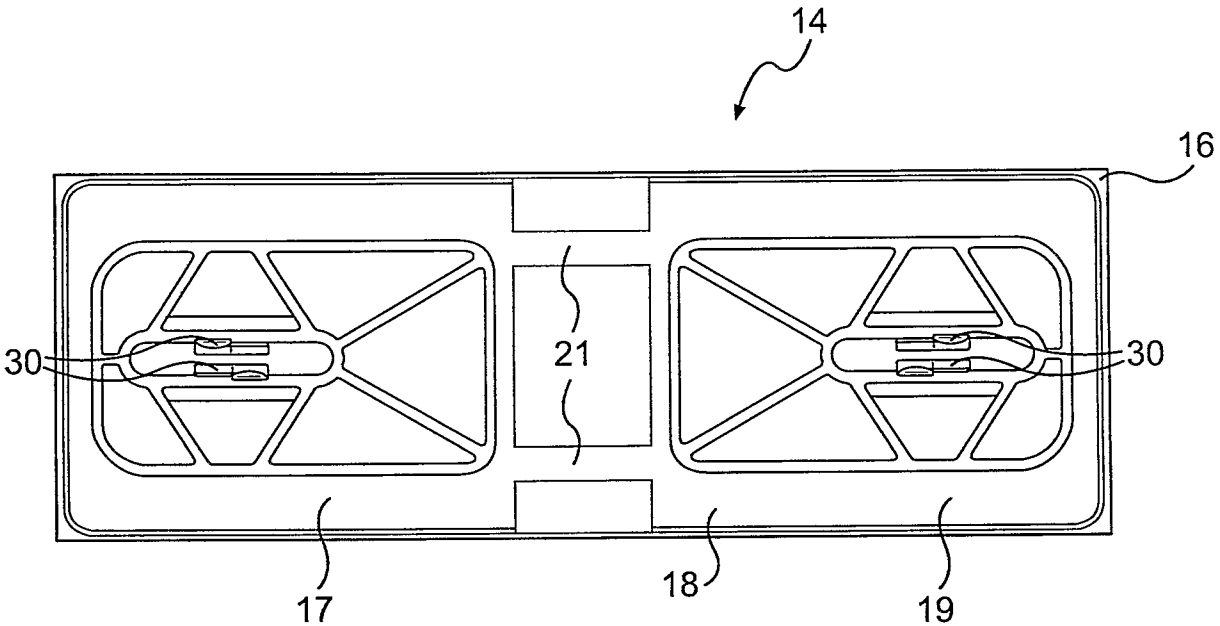
FIG. 7 is a top view of the cleaning head of the cleaning implement of FIG. 1.

To move the mop head 14 to the wringing position, an operator can pull the pull bar 22 upward away from the mop head 14. This movement of the pull bar 22 moves the link 23 and with it the center axis portion of the wing assembly 24 upward. The wing assembly 24 and the mop head 14 are pulled into a U-shaped element 28. The U-shaped element 28 drives a folding operation of the wing assembly with the lower faces of the two sides of the wing assembly 24 being pushed towards each other as the wing assembly 24 is drawn upward into the U-shaped element 28. This folding of the wings, in turn, folds the mop head 14 producing a squeezing of the sponge element 16 and thereby forcing out fluids held in the sponge element 16. As shown in FIGS. 6 and 7, to facilitate the folding movement of the mop head 14, the backing plate 18 can also be configured with two lateral sections 17, 19 that are joined together by flexible hinges 21 with each of the sections of the backing plate 18 corresponding to one of the wings of the wing assembly 24.

For connecting the mop head 14 to the wing assembly 24, a releasable snap-in connection mechanism is provided that allows for easy removal and replacement of the mop head 14.

Figure 8:
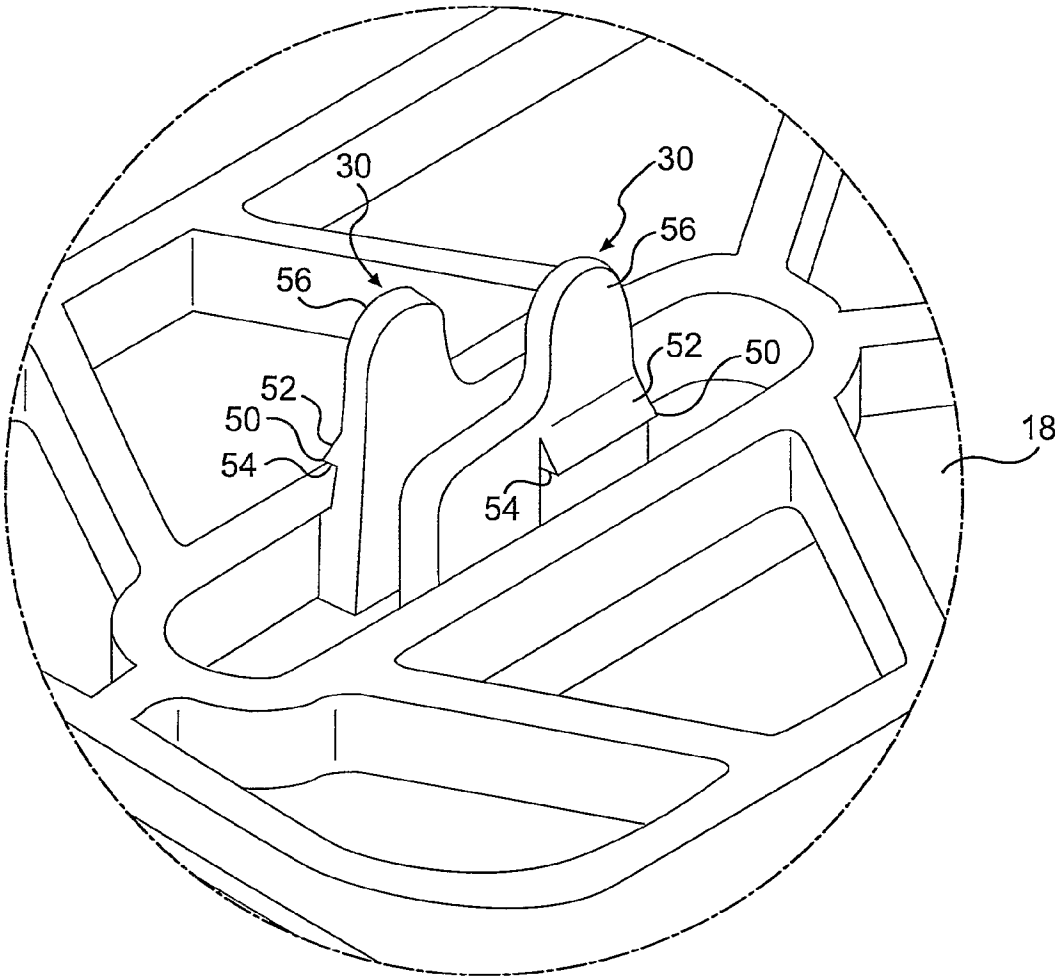
FIG. 8 is an enlarged perspective view of the spring tabs for the cleaning head of FIG. 7.

The connection mechanism, as illustrated, can include two pairs of spring tabs 30 with one pair being arranged on each of the two lateral sections of the backing plate 18 of the mop head 14. The spring tabs 30 extend upward from the backing plate 18 and are resiliently flexible such that they can deflect toward one another. Each pair of spring tabs 30 is adapted to engage with an upper surface of the wing assembly 24 near the perimeter of a corresponding opening 32 in the wing assembly 24. To this end, as shown in FIG. 8, each spring tab 30 includes a ledge 50 on its side that faces away (i.e., outward) from the other spring tab. These ledges 50 can have a ramped lead-in portion 52 so that when the tabs 30 are inserted in the corresponding opening in the wing assembly 24, the engagement of the edge of the opening 32 with the ramped lead-in portion 52 produces a camming action that deflects the corresponding spring tab 30 inward. Once the tab 30 is inserted far enough such that ramped lead-in portion 52 clears the edge of the opening 32, the tabs 30 spring back outward and the engagement of the bases 54 of the ledges 50 with the edges of the openings 32 lock the tabs 30 to thereby secure the mop head 14 to the wing assembly 24 as shown in FIG. 3.

The tabs 30 are configured such they protrude upward a sufficient distance beyond the upper surface of the wing assembly 24 so that when the mop head 14 is attached to the wing assembly 24, a user can grasp the tabs 30 at finger grips 56 to remove the mop head 14. In particular, to remove the mop head 14, a user can grasp each of the pair of tabs 30 with a single hand and move the tabs 30 by deflecting each pair inward. To facilitate the removal of the mop head 14, the tabs 30 of each pair can be offset from each other to make it easier to grasp the tabs 30 as well as to permit a greater inward deflection of the tabs 30 by preventing the interference of the finger grips 56 as the tabs 30 move toward one another. When the tabs are deflected inwardly a sufficient distance to disengage their respective ledges 50 from the edges of the corresponding openings 32 in the wing assembly 24, the mop head 14 can be easily removed from the wing assembly. Offsetting the tabs 30, such as shown being laterally offset in the figures, also allows the mop head 14 to be removed through a twisting motion of the user's hand. The twisting motion makes removal easier for a user because the force applied to the tabs 30 can be predominantly supplied by the wrist, transmitted for example by the thumb and forefinger respectively placed on opposing tabs 30, rather than the thumb and forefinger themselves supplying a directly opposing force to the tabs 30.

It will be appreciated that any suitable number of tabs may be used with any suitable number of openings in a cleaning end of a cleaning implement. The tabs can have any suitable shape and size. It will further be appreciated that the features described herein may be used with any suitable cleaning implement using any suitable cleaning head, including, but not limited to, a mop and a mop head.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cleaning implement comprising:

a handle;

a cleaning end coupled to the handle; and a cleaning head removably coupled to the cleaning end, the cleaning head including a pair of opposing tabs extending through an aperture in the cleaning end, each tab having a finger grip that is engageable by a user, each finger grip being bordered by an upper edge and a pair of side edges depending from the upper edge, the pair of side edges being spaced from each other in a lateral direction, the finger grips of the pair of opposing tabs being offset from one another in the lateral direction, each tab having a ledge for contacting an upper surface of the cleaning end near a perimeter of the aperture to retain the cleaning head to the cleaning end, the tabs being movable such that the ledges are moved out of contact with the upper surface of the cleaning end when removing the cleaning head from the cleaning end.

2. The cleaning implement of claim 1 wherein the cleaning end includes two apertures and the cleaning head includes two pairs of tabs.

3. The cleaning implement of claim 1 wherein the tabs are movable toward one another to remove the cleaning head from the cleaning end.

4. The cleaning implement of claim 1 wherein the tabs are movable through a twisting motion of a user's hand to move the ledges out of contact with the upper surface of the cleaning end when removing the cleaning head from the cleaning end.

5. The cleaning implement of claim 1 wherein the cleaning head further comprises a cleaning material and a backing, and wherein the tabs extend from the backing.

6. The cleaning implement of claim 5 wherein the tabs are coupled to the backing in a generally parallel arrangement with one another.

7. The cleaning implement of claim 1 wherein each tab includes a ramp such that as the cleaning head is being attached to the cleaning end, the ramps contact the cleaning end to move the tabs until the ledges pass through the aperture.

8. The cleaning implement of claim 7 wherein the ramps are generally offset from one another.

9. The cleaning implement of claim 7 wherein the ramps are disposed on the tabs between the finger grips and the backing.

10. A cleaning head comprising:

a cleaning material;

a backing coupled to the cleaning material; and a pair of opposing tabs extending from the backing, each tab having a finger grip that is engageable by the user, each finger grip being bordered by an upper edge and a pair of side edges depending from the upper edge, the pair of side edges being spaced from each other in a lateral direction, the finger grips of the pair of opposing tabs being offset from one another in the lateral direction, and each tab having a ledge, wherein the tabs are movable through a twisting motion of a user's hand when removing the cleaning head from a cleaning implement.

11. The cleaning head of claim 10 further comprising a second pair of tabs.

12. The cleaning head of claim 10 wherein the tabs are movable toward one another.

13. The cleaning head of claim 10 wherein the tabs are coupled to the backing in a generally parallel arrangement with one another.

14. The cleaning head of claim 10 wherein each tab includes a ramp.

15. The cleaning head of claim 14 wherein the ramps are generally offset from one another.

16. The cleaning head of claim 14 wherein the ramps are disposed on the tabs between the finger grips and the backing.

17. A cleaning implement comprising:

a handle;

a cleaning end coupled to the handle, the cleaning end having an aperture extending therethrough; and a cleaning head including a sponge element removably coupled to a lower surface of the cleaning end, the cleaning head including a pair of opposing tabs extending through the aperture in the cleaning end, each tab having a finger grip, each tab having a ledge for contacting an upper surface of the cleaning end near a perimeter of the aperture to retain the cleaning head to the cleaning end, each tab being movable such that the ledge is moved out of contact with the upper surface of the cleaning end when removing the cleaning head from the cleaning end.

* * * * *